US010525729B2

(12) United States Patent
Peinado et al.

(10) Patent No.: US 10,525,729 B2
(45) Date of Patent: Jan. 7, 2020

(54) PRINTER CALIBRATION TECHNIQUES

(71) Applicant: Hewlett-Packard Development Company, L.P., Houston, TX (US)

(72) Inventors: David Peinado, Sant Cugat del Valles (ES); Jordi Bas, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/098,118

(22) PCT Filed: Jul. 12, 2016

(86) PCT No.: PCT/EP2016/066560
§ 371 (c)(1),
(2) Date: Oct. 31, 2018

(87) PCT Pub. No.: WO2018/010772
PCT Pub. Date: Jan. 18, 2018

(65) Prior Publication Data

US 2019/0143711 A1 May 16, 2019

(51) Int. Cl.
*B41J 2/21* (2006.01)
*B41J 2/045* (2006.01)
*B41J 2/155* (2006.01)

(52) U.S. Cl.
CPC ..... *B41J 2/2146* (2013.01); *B41J 2/04561* (2013.01); *B41J 2/155* (2013.01); *B41J 2202/19* (2013.01); *B41J 2202/21* (2013.01)

(58) Field of Classification Search
CPC ..... B41J 2/04561
See application file for complete search history.

(56) References Cited

U.S. PATENT DOCUMENTS

| | | | | |
|---|---|---|---|---|
| 6,655,771 | B2 * | 12/2003 | Matsumoto | B41J 2/15 347/12 |
| 7,118,188 | B2 | 10/2006 | Vilanova et al. | |
| 7,278,699 | B2 | 10/2007 | Drake et al. | |
| 8,393,709 | B2 | 3/2013 | Enge | |
| 8,419,159 | B2 | 4/2013 | Govyadinov et al. | |
| 2006/0158477 | A1 | 7/2006 | Kusakari et al. | |
| 2009/0231374 | A1 | 9/2009 | Van de Wynckel et al. | |

FOREIGN PATENT DOCUMENTS

WO WO-2014116209 A1 7/2014

OTHER PUBLICATIONS

Notenboom, A., et al, "Mechatronic Design of an Active Printhead Alignment Mechanism for Wide Format Printing Systems", Oct. 16, 2006, 12 pages.
Technical White Paper, HP Pagewide Technology, 4AA5-5186NW, Dec. 2014, Rev.1, 8 pages.

* cited by examiner

*Primary Examiner* — Julian D Huffman
(74) *Attorney, Agent, or Firm* — HP Inc. Patent Department

(57) ABSTRACT

A printing device comprises a droplet generator for generating a droplet of printing fluid, a droplet detector for detecting a generated droplet of printing fluid, and a controller. The droplet detector is moveable along an axis. The controller is to cause the droplet detector to be positioned at a known location along the axis, cause the droplet generator to generate a droplet, receive a measurement signal from the droplet detector, and determine a location of the droplet generator based on the received measurement signal and the known location.

14 Claims, 4 Drawing Sheets

PRINTER CALIBRATION TECHNIQUES

BACKGROUND

In a print device an image is printed on a print medium. A print device, such as an inkjet printer, may comprise at least one print head arranged to deposit a printing fluid such as ink upon the print medium. The at least one print head may be controlled by a print controller. Such a print controller receives an input image to be printed and generates a number of signals to control the print device. Based on these signals the printing fluid is ejected from the print head. Many print devices incorporate some form of relative movement between the print medium and the print head so that printing fluid is deposited onto an appropriate area of the print medium. The print controller thus coordinates the timing of the signals used to control the print device such that an output image is printed in the right place on a print medium.

BRIEF DESCRIPTION OF THE DRAWINGS

Various features of the present disclosure will be apparent from the detailed description which follows, taken in conjunction with the accompanying drawings, which together illustrate, by way of example, features of the present disclosure, and wherein.

DETAILED DESCRIPTION

Figure 1:
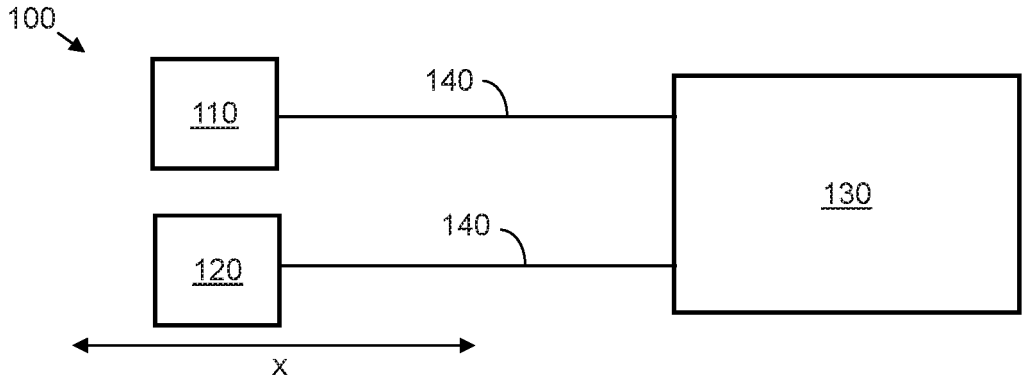
FIG. 1 is a schematic diagram of a printing device according to an example.

In the following description, for purposes of explanation, numerous specific details of certain examples are set forth. Reference in the specification to "an example" or similar language means that a particular feature, structure, or characteristic described in connection with the example is included in at least that example, but not necessarily in other examples.

Certain examples described herein relate to printing systems and methods of printing. In particular, certain examples relate to ink-jet printing systems that move a print medium in relation to at least one ink-jet. The movement may be due to the movement of an ink-jet across the width of the print medium, or in the case of page-wide array printing, the movement of the medium itself through an ink-jet running across the width of the medium.

A printing system may include a printer. In certain cases, the printer may be an inkjet printer, for example a scanning inkjet printer or a page-wide array printer. A page-wide array printer may for example comprise an array of printheads, or may comprise a single printhead comprising an array of nozzles. Such a printing system may comprise a plurality of print elements. A print element may be, for example, a print head, a die (a silicon piece in which at least one printing nozzle is formed), or a printing nozzle. A print head may comprise one, two or several dies. A print head may comprise a plurality of nozzles. Each nozzle may be arranged to deposit drops of a printing fluid, such as an ink, a gloss and/or a varnish. There will be a set amount of printing fluid that is released in each drop, e.g. a large drop has a different volume of printing fluid to a small drop. Certain printers may deposit a plurality of printing fluid drops when an instruction is received to actuate the nozzles, e.g. the printer may receive a command based on image data to deposit d drops of printing fluid for a given pixel. The volume of printing fluid released by a nozzle in a single drop may be referred to as its ink drop density (IDD). It may be assumed that the IDD across a given die is constant, and also assumed that the IDD across many dies can be different. For example, some print heads may allow drops of different sizes to be ejected.

In certain other cases, the printer of the printing system may be a laser printer, or a photocopying machine, a print element may be an electrostatic drum and a toner material may be deposited onto the electrostatic drum and transferred to a medium to obtain a print output. In some cases the printer of the printing system may be a 3D printer, and a print element may be comprised in a deposit mechanism for depositing a build material or agent to be used in the generation of a 3D object by the 3D printer.

More generally, examples described herein apply to printing systems, for example, which are to generate a print output based on a deposition of material, such as an ink or a toner, or in any other kind of printing system that deposits different materials or fluids to create an image.

In an example printing system, a media transport system ("media transport" for short) may be arranged to transport print media relative to a print head. In a page-wide array printer, at least one print head may be mounted on a print bar above a media transport path. In these cases the media transport may transport a print medium underneath the print head. In certain cases, the media transport may comprise a system that moves the at least one print head in relation to a print medium; in other cases a combination of print head and print media movement may be effected.

Certain examples described herein relate to configuring and/or calibrating a printing system. Calibrating a printing system modifies its print output. Calibration may be performed according to calibration data. In particular, certain examples relate to configuring and/or calibrating a printing system to compensate for variations in the alignment of print head nozzles. For example, in a page-wide array printer the positions of the print heads, and also the positions of the dies within a given print head, may vary slightly along the print bar (crossweb) axis and/or along the media (downweb) axis due to mechanical tolerances. An applied calibration may modify print data to account for a difference in the real position of a given nozzle from a nominal position of that nozzle. For example, position data comprised in the print data may be translated according to a vector determined based on a difference between an actual (real) position of a given nozzle and a nominal position of that nozzle.

Examples described herein relate to determining a real position of a given nozzle, for example to enable calibration data to be determined based on a difference between the determined real position and a nominal position for the given nozzle.

FIG. 1 shows a printing device 100 according to an example. The printing device 100 comprises a droplet generator 110 and a droplet detector 120. The droplet generator 110 is for generating a droplet of printing fluid. The droplet detector 120 is for detecting a droplet of printing fluid. The droplet detector 120 is moveable along an axis x. Each of the droplet generator 110 and the droplet detector 120 is connected to a controller 130 by a communications link 140, which may be wired or wireless.

The printing device 100 may be used to produce a print output, for example comprising printing fluid deposited on a print medium. The print output may be produced based on print data received by the controller 130. The controller 130 may process received print data to generate control data. The control data may be to cause the droplet generator 110 to emit droplets according to a sequence or pattern defined by the print data. The print data and/or the control data may be generated based on a premise that the droplet generator is located along the axis x at a nominal location stored in a memory of the printing device 100. In some examples the controller may receive and/or generate calibration data, where a calibration is to be applied to the printing system. The controller 130 may process the calibration data to modify the outputted control data communicated to the printing device 100. In this way, calibration data can modify the generated print output from the printing device 100 as instructed by the print control data.

The droplet generator 110 may comprise a nozzle. In some examples the nozzle is comprised in a print head. In some examples the nozzle is comprised in a die of a print head. In some examples the printing device 100 comprises a further droplet generator, which may have some or all of the features described in relation to the droplet generator 110. In some examples the printing device 100 may comprise a plurality of further droplet generators, which may each have some or all of the features described in relation to the droplet generator 110.

Figure 2:
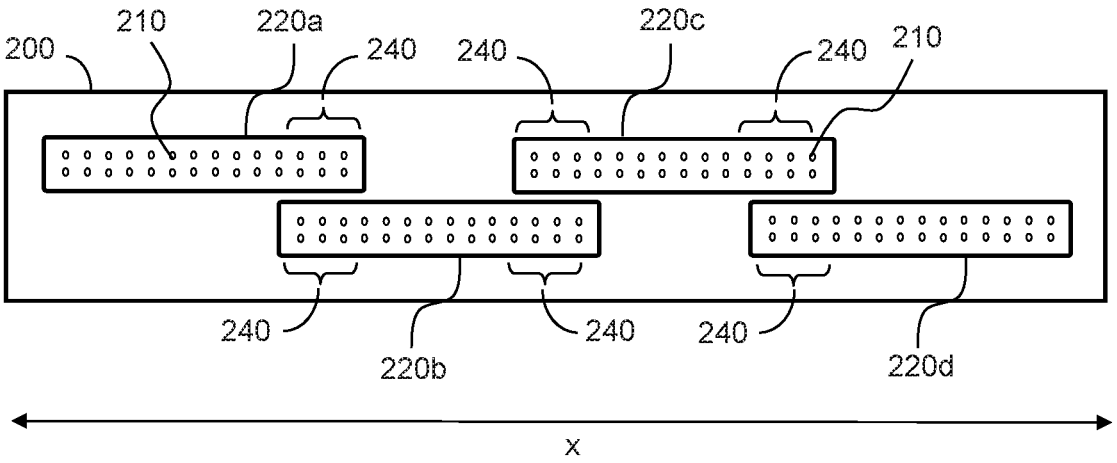
FIG. 2 is a schematic diagram of a print bar of a printing device according to an example.

FIG. 2 shows a print bar 200 of an example printing device having a plurality of droplet generators 210. The example printing device may, for example, comprise a page-wide array printer. The print bar 200 comprises a plurality of dies 220*a-d*. Each die 220*a-d* comprises a plurality of droplet generators 210. The dies 220*a-d* are arranged such that each die comprises at least one overlap region 240. Each overlap region of a given die overlaps, in the axial direction (that is, a direction along the long axis of the print bar 200, which is parallel to the axis x along which the droplet detector 120 is moveable), an overlap region 240 of an adjacent die. The dies 220*a* and 220*d* each comprise one overlap region 240, whereas the dies 220*b* and 220*c* each comprise two overlap regions 240.

The droplet detector 120 may be mounted on or otherwise comprised in a service carriage of the printing device 100. Such a service carriage may be moveable along the axis x. Movement of the droplet detector 120 may be controlled using a linear encoder, which may synchronize movement of the droplet detector 120 with other aspects of the operation of the droplet detector 120.

Figure 3:
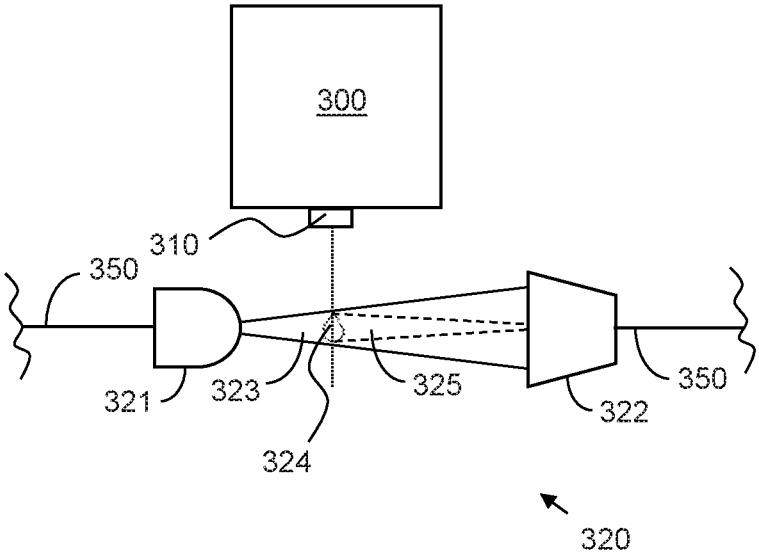
FIG. 3 is a schematic diagram of a printing device according to an example

The droplet detector 120 may comprise a light emitter and a light detector. FIG. 3 shows an example droplet detector 320 of an example printing device 300 (which may, for example, be the printing device 100). The printing device 300 is to emit droplets of printing fluid from a droplet generator 310. The droplet detector 320 comprises a light emitter 321 to emit light along an optical axis, and a light detector 322. The light emitter 321 and the light detector 322 are in communication with a controller of a printing device (e.g. the controller 130) via communications links 350, which may be wired or wireless.

The light detector 322 may be located relative to the light emitter 321 such that, in use, a peak of a spatial intensity distribution profile of light emitted by the light emitter 321 is incident on the light detector 322. A location of such a peak relative to the light detector may be known. In some examples the location of such a peak may correspond to the centre of a field of view of the light detector 322. The light emitter 321 may be, for example, an LED. In other examples, the light emitter 321 may be another type of light emitting device, such as a laser. The light detector 322 may be, for example, a photodiode. In other examples, the light detector 322 may be any suitable device for detecting light. For example, the light detector 322 may be an active pixel sensor, a charge-coupled device or a direct-conversion radiation detector. The light detector 322 may detect light incident from a range of angles incident within an aperture of the light detector 322. The aperture may be a physical window to occlude light outside of an area of detection or may be an optical numerical aperture defined by the surface of the detector 322.

The light emitter 321 may emit a continuous (i.e. not pulsed) beam 323 of light that is detectable by the light detector 322. In some examples the light emitter 321 may emit a pulsed beam 323 of light having a pulse frequency that is sufficiently high to reliably detect droplets. For example, the pulse frequency may be greater than 20 kHz. In some examples, the light emitter 321 may emit a pulsed beam 323 of light extending over a period in which a droplet is ejected. For example, the duration of the pulse may be greater than 25 μs.

The light detector 322 may generate a signal representative of an intensity of light incident on an aperture of the light detector 322. For example, the light detector 322 may generate a voltage signal, a current signal, or a combination of voltage and current signals representative of the intensity of incident light. The droplet detector 320 may include detection circuitry (not shown) to monitor the signal generated by the light detector 322. In some examples, the detection circuitry may be separate to the light detector 322, while in other examples the detection circuitry may be integral with the light detector 322. When the beam of light emitted by the light emitter 321 is interrupted, the signal generated by the light detector 322 may vary. In turn, the detection circuitry may detect a variation in the signal generated by the light detector 322. For example, the detection circuitry may detect a reduction in a value of the signal generated by the light detector 322 when the beam of light is interrupted. FIG. 3 shows the light beam 323 being interrupted by a droplet 324 such that a shadow 325 is created. Where the shadow 325 intersects the light detector 322, a low light intensity level will be measured by the light detector 322. Thus, when the beam 323 of light emitted by the light emitter 321 is interrupted by a droplet of fluid, this may be detected by detecting a variation in the signal generated by the light detector 322. In some examples the detection circuitry is arranged to output a signal representative of a magnitude of a detected variation in the signal generated by the light detector 322. The measurement signal output by the droplet detector 320 and received by a controller of a printing device (e.g. the controller 130) may comprise the signal representative of a magnitude of a detected variation in the signal generated by the light detector 322.

Figure 4:
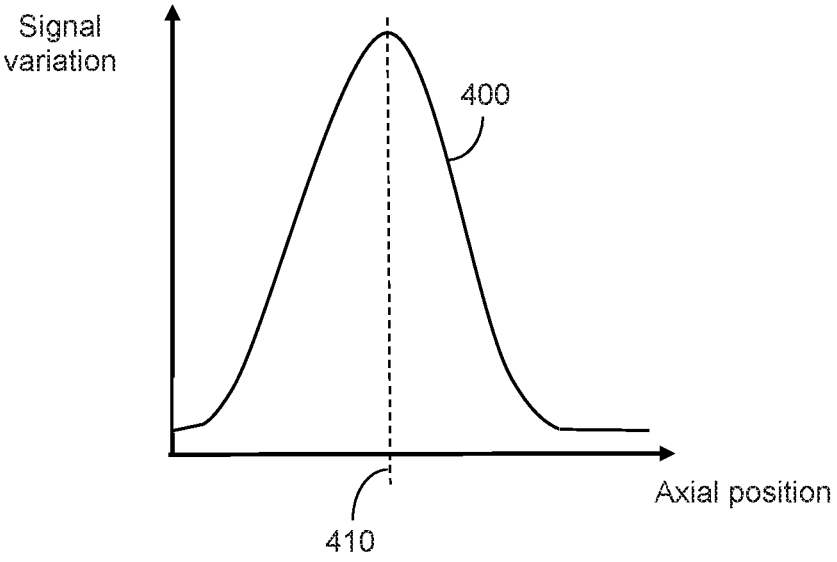
FIG. 4 is a schematic illustration of a measurement signal generated by a light detector of an example.

FIG. 4 shows an example measurement signal 400 output by a droplet detector, for example the droplet detector 320. The signal 400 is representative of a magnitude of a detected variation in a light intensity signal generated by a light detector. The signal 400 varies with axial position, and comprises a peak at an axial position indicated by the dashed line 410. The peak indicates a location of maximum variation in the signal generated by the light detector. This maximum variation will occur when a droplet passes through the peak of the spatial intensity distribution profile of a light beam emitted by a light emitter of the droplet detector. The axial position of the peak of the spatial intensity distribution of a light beam emitted by a light emitter of the droplet detector, in relation to the other components of the droplet detector and in particular in relation to the aperture of the light detector, is known, for example because it is set during manufacture or calibration of the droplet detector. In the following discussion, references to the axial location of a droplet detector should be understood as referring to the location of an axial point on the droplet detector corresponding to the location of the peak of the spatial intensity distribution of a light beam emitted by a light emitter of the droplet detector. However; the axial location of the peak of the spatial intensity distribution of a light beam emitted by a light emitter of the droplet detector may be fixed in relation to the other components of the droplet detector and may therefore be calculated based on an axial location of any other component of the droplet detector.

In examples where the light detector comprises an aperture which has a width in the axial direction (that is, a direction along the axis x), a measurement signal covering a range of axial positions corresponding to the axial width of the light detector aperture will be acquired for a given axial location of the droplet detector. A measurement signal covering a range of axial positions greater than the axial width of the light detector aperture can be acquired by moving the droplet detector through a plurality of different axial locations. It will be appreciated that whether or not such movement is required in order to generate a measurement signal having a detectable peak will depend on the axial width of the light detector aperture.

In some examples the droplet detector 320 may comprise plural light emitters and plural light detectors, each of which may have the features of the light emitter 321 and a light detector 322 respectively, as described above. The plural light emitters and plural light detectors may be arranged in emitter-detector pairs such that a light emitter of a given pair is to emit a beam which is incident on the light detector of that pair. The emitter-detector pairs may be each be located at a different axial position (i.e. with respect to the axis x along which the droplet detector 320 is moveable). Each emitter-detector pair may be located at a preselected axial position. The axial separation between each emitter-detector pair may be constant. The axial separation between each emitter-detector pair may correspond to the axial separation between axially adjacent droplet generators of a printing device in which the droplet detector 320 is comprised. The axial separation between each emitter-detector pair may be such that light emitted from a light emitter of a given pair is not detectable by the light detector of a neighboring pair. A separate measurement signal may be generated in respect of each emitter-detector pair. A droplet detector comprising plural light emitters and plural light detectors may therefore be able to determine the location of multiple droplet generators simultaneously.

The controller 130 is to cause the droplet detector 120 to be positioned at a known location along the axis x, to cause the droplet generator 110 to generate a droplet, to receive a measurement signal from the droplet detector 120, and to determine a location of the droplet generator 110 based on the received measurement signal and the known location. In some examples the known location corresponds to a nominal location of the droplet generator 110 stored in a memory of the printing device 100.

In some examples the controller 130 is to move the droplet detector 120 to a different known location along the axis x, and to cause the droplet generator 110 to generate a further droplet. The different known location may be a predefined distance from the known location. The different known location may not correspond to a nominal location of the droplet generator 110, and may also not correspond to a nominal location of any other droplet generator of the printing device 100. The different known location may be between a nominal location of the droplet generator 110 and a nominal location of a neighboring further droplet generator. In some examples the controller is to cause the droplet detector 120 to move through a range of axial locations, including the known location. In some examples the controller 130 is to move the droplet detector 120 through a plurality of different known locations. In one such example, the controller 130 is to continuously move the droplet detector 120 along the axis, such that the droplet detector 130 passes through the known location and a plurality of different known locations during the continuous movement.

As discussed above, for droplet detectors of the type shown in FIG. 3, the greatest reduction in the amount of light detected by the light detector 322 will be experienced when a droplet passes through the peak of the spatial intensity distribution profile of the light beam 323 emitted by the light emitter 321. A measurement signal representative of a magnitude of a detected variation in a light intensity signal generated by the light detector 322 (e.g. the signal 400 of FIG. 4) is therefore expected to be at a maximum when the axial location of the droplet detector 320 is such that the peak of the spatial intensity distribution profile of the light beam 323 is at the same axial location (i.e. the same location along the axis x) as the droplet generator 110.

If the axial position of the droplet detector 320 is different to the axial position of the droplet emitter 310, then the droplet will not pass through the peak of the spatial intensity distribution profile of the light beam 323, and the magnitude of the detected variation will consequently be less than when a droplet passes through the peak of the spatial intensity distribution profile. The closer the droplet passes to the peak, the greater the magnitude of the detected variation will be. The amplitude of the measurement signal output by the droplet detector 320 is therefore dependent on a difference between an axial location of the droplet detector 320 and an axial location of the droplet generator 310. Therefore, in some examples the controller is to determine the location (i.e. the location on the axis x) of the droplet generator 310 by determining an axial location that corresponds to a maximum amplitude of the measurement signal to be the axial location of the droplet generator. An axial location that corresponds to a maximum amplitude of the measurement signal can be found, for example, by moving the droplet detector 320 to each of a plurality of axial locations and, at each of the plurality of axial locations of the droplet detector 320, emitting a droplet from the droplet generator 310 and acquiring a corresponding measurement signal.

In some examples the controller is to calculate at least one element of a correction vector for correcting print data, based on the determined location of the droplet generator.

In examples in which the printing device 100 comprises a further droplet generator, the controller may be to cause the droplet detector 120 to be positioned at a further known location along the axis, to cause the further droplet generator to generate a droplet, to receive a further measurement signal from the droplet detector 120, and to determine a location of the further droplet generator based on the received further measurement signal and the further known location. In some examples the further known location corresponds to a nominal location of the further droplet generator stored in a memory of the printing device 100. In some examples the controller may be to move the droplet detector to a different known location along the axis (i.e. a known location different to the further known location) and to cause the droplet generator to generate a further droplet whilst positioned at the different known location. Moving the droplet detector to a different known location different to the further known location may be performed as described above in relation to moving the droplet detector to a different known location different to the known location.

In some examples the controller 130 is to modify print data based on a determined location of a droplet generator 110. In some examples the controller 130 is to modify print data based on determined locations of a plurality of droplet generators 110, for example each droplet generator comprised in an overlap region of a print die of the printing device 100. The print data may relate to a plurality of droplet generators, e.g. each droplet generator comprised in a print bar of a page-wide array printer. The print data may comprise a set of property values in respect of each droplet generator 110. The print data may have been generated based on a premise that each droplet generator 110 is located along the axis (i.e. the axis x) at a respective nominal location for that droplet generator. The print data may be defined as an array of property values and associated nominal droplet generator locations. In some examples the controller 130 is to apply a correction value to at least one nominal droplet generator location comprised in the print data. In some examples the controller is to calculate a correction vector comprising a correction value (which may, for some droplet generators, be zero) in respect of each nominal droplet generator location. A given element of such a correction vector, relating to a nominal location of a given droplet generator, may be calculated based on a determined location of the given droplet generator. The controller may be to apply a calculated correction vector to the print data, using any suitable known technique. The controller 130 may be to generate control data based on the print data and on the calculated correction vector, using any suitable known technique.

Figure 5:
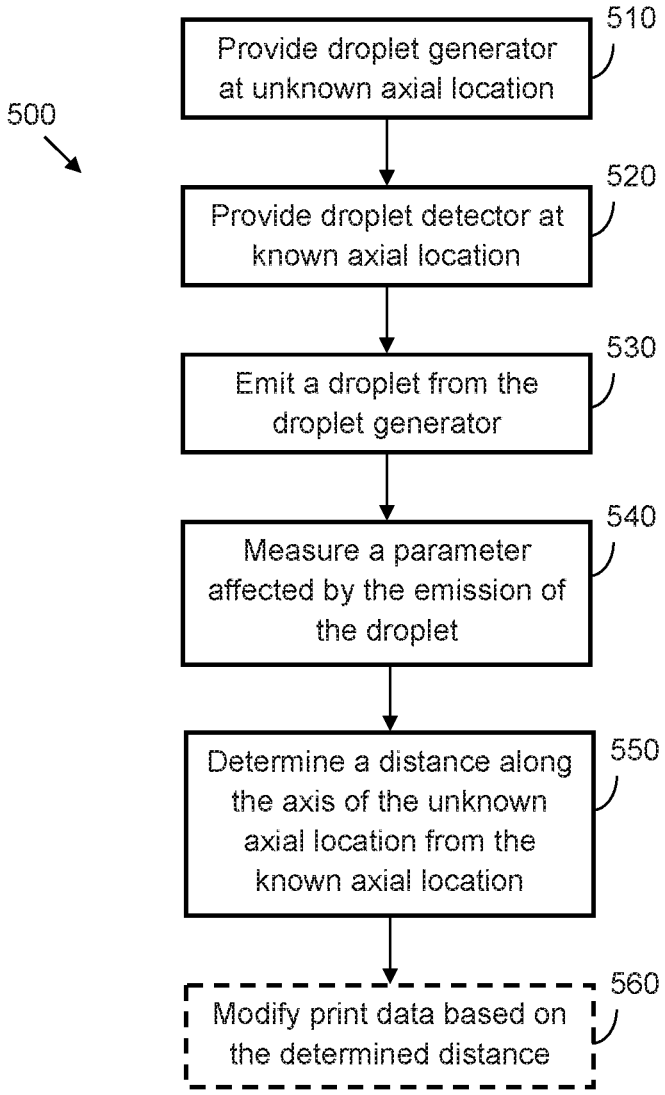
FIG. 5 is a flow diagram of a method according to an example.

FIG. 5 is a flow chart that implements an example of a method 500, e.g. for determining the position of a given droplet generator of a printing device. The method 500 may be performed, for example, by a printing device of this disclosure. In some examples at least one block of the method 500 may be encoded as one or a plurality of machine readable instructions stored on a memory accessible by a controller of a printing device of this disclosure. In discussing FIG. 5 reference is made to the diagrams of FIGS. 1-4 to provide contextual examples. Implementation, however, is not limited to those examples.

The method 500 includes providing a droplet generator at an unknown axial location along a predefined axis (block 510). The droplet generator may be comprised in a printing device, e.g. the printing device 100 or the printing device 300. The droplet generator may have any or all of the features of the droplet generator 110 or the droplet generator 310 as described above. The predefined axis may be parallel to the long axis of a print bar, e.g. a print bar of a page-wide array printer. The unknown axial location may be determined during manufacturing of the printing device. The unknown axial location may be dependent on a variable factor or a combination of variable factors of a manufacturing process used to manufacture the droplet generator and/or the printing device. Performing block 510 may comprise providing a print bar, print head or print die comprising the droplet generator.

The method 500 further includes providing a droplet detector at a known axial location along the predefined axis (block 520). The droplet detector may be comprised in the printing device. The droplet detector may have any or all of the features of the droplet detector 120 or the droplet detector 320 as described above. Performing block 520 may comprise moving the droplet detector, e.g. under the control of a controller of the printing device, to the known axial location. Performing block 520 may comprise positioning a particular point on the droplet detector at the known axial location. The known axial location may or may not be the same as the unknown axial location at which the droplet generator is provided. The known axial location may correspond to a nominal location of a droplet generator of the printing device, the nominal location being stored in a memory accessible to the controller of the printing device. The known axial location may be located such that a droplet emitted by a droplet generator located at a nominal location would be expected to pass through a beam of light emitted by a light emitter of the droplet detector, when the droplet detector is positioned at the known axial location.

The method 500 further includes emitting a droplet from the droplet generator (block 530). In examples in which the droplet detector comprises a light emitter, the emitted droplet may pass through a beam of light emitted by the light emitter of the droplet detector. Block 530 may be performed in any suitable manner. For example, performing block 530 may comprise the controller transmitting a signal to circuitry of the droplet generator to activate the droplet generator. The droplet may be emitted in the same manner as a droplet would be emitted during a printing operation performed by the printing device. Performing block 530 may comprise emitting a droplet at a preselected time. A time at which the droplet is emitted may be recorded by the controller. Recording a time at which the droplet is emitted may enable the effect of the droplet on a measurement signal output by the droplet detector to be more easily detected.

The method further includes measuring, e.g. with the droplet detector, a parameter affected by the emission of the droplet. The parameter may be, for example, a property of light incident on a light detector comprised in the droplet detector. The property may be, for example, light intensity, variation in light intensity, light modal frequency, variation in light modal frequency, etc. In examples in which the droplet detector comprises a light emitter and a light detector, the droplet may pass through the beam of light emitted by the light emitter and cause a variation in the signal generated by the light detector. As discussed above in relation to the operation of the droplet detector 320, the nature of the variation will be different depending on whether the droplet generator is located at the nominal location (in which case the droplet will pass through the optical axis of the beam) or is offset from the nominal location (in which case the droplet will pass to one side of the optical axis of the beam). The measuring may be performed in any of the manners described above in relation to the operation of the example droplet detector 120 or the example droplet detector 320. The droplet detector may be stationary during the measuring. As another example, the droplet detector may move along the predefined axis during the measuring, in a well-defined manner such that its axial position at any given time is known. Performing block 540 may comprise generating a measurement signal, which may have any or all of the features of the measurement signal 400 described above.

In some examples blocks 520-540 may be repeated, with the droplet detector being provided at a different axial location for each iteration. This may enable a measurement signal covering a relatively wider range of axial positions to be generated than if the droplet detector measures the parameter at a single known location.

The method 500 further includes determining, based on the measurement of the parameter, a distance along the predefined axis of the unknown axial location from the known axial location (block 550). Block 550 may be performed by the controller. Determining the distance may be performed in any of the manners described above in relation to the operation of the controller 130. For example, performing block 550 may comprise analyzing or otherwise processing a measurement signal output by the droplet detector. Performing block 550 may comprise determining the location of a peak in a measurement signal output by the droplet detector. Performing block 550 may comprise comparing the location of a peak in a measurement signal output by the droplet detector with a nominal location of the droplet generator.

In examples in which the method 500 is being implemented in respect of a printing device comprising multiple droplet generators, blocks 510-550 may be repeated in respect of at least one further droplet generator. Blocks 510-550 may be performed in respect of each droplet generator comprised in the printing device. Blocks 510-550 may be performed in respect of each droplet generator comprised in an overlap region of a print head die of the printing device. In some examples different droplet generators may be operated according to a predetermined pattern. The droplet generators may be operated sequentially, for example. In some examples, the droplet generators may be operated in a pseudo-random order in order to minimize fluidic interference between droplets.

In some examples the method 500 may further include an additional block 560. In block 560, print data is modified based on the determined distance along the predefined axis of the unknown axial location from the known axial location. The print data may have any of the features described above in relation to the operation of the controller 130.

Although the flow diagram in FIG. 5 shows a specific order of execution, the order of execution may differ from that which is depicted. For example, the order of execution of two or more blocks may be scrambled relative to the order shown. Also, two or more blocks shown in succession may be executed concurrently or with partial concurrence. All such variations are contemplated.

Figure 6:
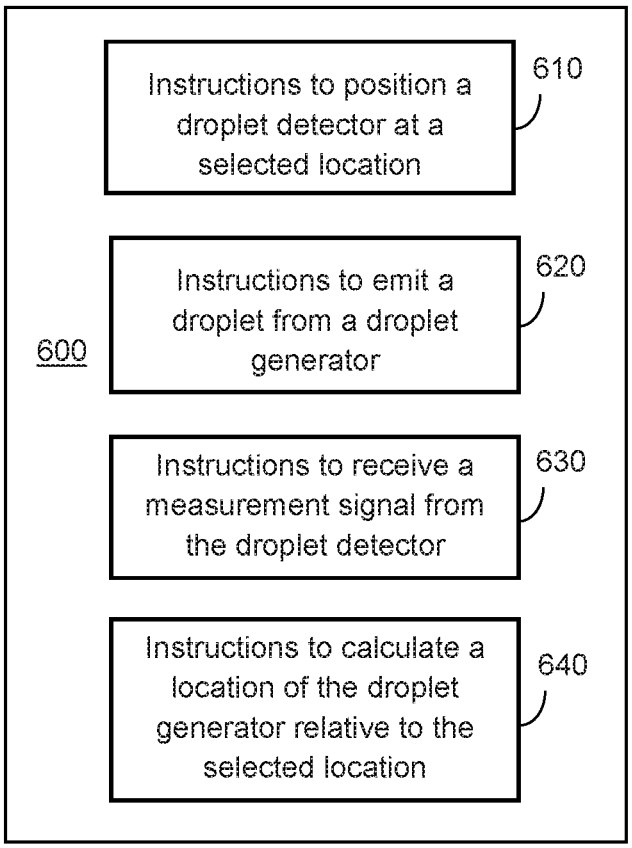
FIG. 6 is a schematic diagram of a non-transitory machine readable storage medium according to an example.

As mentioned above, in some examples at least part of a method of this disclosure may be encoded as one or a plurality of machine readable instructions stored on a memory accessible by a controller of a printing device of this disclosure. FIG. 6 shows an example non-transitory machine readable storage medium 600 encoded with instructions executable by a processor, e.g. a processor of the controller 130. The machine-readable storage medium 600 comprises instructions 610 to position a droplet detector at a selected location; instructions 620 to emit a droplet from a droplet generator; instructions 630 to receive a measurement signal from the droplet detector; and instructions 640 to calculate, based on a received measurement signal from the droplet detector, a location of the droplet generator relative to the selected location. In some examples the machine readable storage medium 600 may further include instructions to modify print data based on a calculated location of the droplet generator.

Certain examples described herein provide a convenient way to account for location variations, e.g. due to manufacturing tolerances, of print elements. Such print elements may be, for example, print elements in a page-wide array printer. For example, implementation of the examples does not involve printing a calibration pattern, meaning that paper is not consumed by implementing the examples. Moreover, the droplet detection based techniques described herein can be performed significantly more quickly than techniques which involve scanning a printed calibration pattern.

In the foregoing description, numerous details are set forth to provide an understanding of the examples disclosed herein. However, it will be understood that the examples may be practiced without these details. While a limited number of examples have been disclosed, numerous modifications and variations therefrom are contemplated. It is intended that the appended claims cover such modifications and variations. Claims reciting "a" or "an" with respect to a particular element contemplate incorporation of at least one such element, neither requiring nor excluding two or more such elements. Further, the terms "include" and "comprise" are used as open-ended transitions.

What is claimed is:

1. A printing device comprising:

a droplet generator for generating a droplet of printing fluid;

a droplet detector for detecting a generated droplet of printing fluid, the droplet detector being moveable along an axis; and a controller to:

cause the droplet detector to be positioned at a known location along the axis, cause the droplet generator to generate a droplet;

receive a measurement signal from the droplet detector, and determine a location of the droplet generator based on the received measurement signal and the known location.

2. A printing device according to claim 1, the controller further being to:

move the droplet detector to a different known location along the axis; and cause the droplet generator to generate a further droplet.

3. A printing device according to claim 1, the known location corresponding to a nominal location of the droplet generator stored in a memory of the printing device.

4. A printing device according to claim 1, comprising a further droplet generator for generating a droplet of printing fluid, and the controller being further to:

cause the droplet detector to be positioned at a further known location along the axis;

cause the further droplet generator to generate a droplet;

receive a further measurement signal from the droplet detector; and determine a location of the further droplet generator based on the received further measurement signal and the further known location.

5. A printing device according to claim 1, the controller further being to cause the droplet detector to move through a range of axial locations, including the known location.

6. A printing device according to claim 1, the droplet detector comprising a light emitter and a light detector, and wherein the measurement signal is representative of variation in intensity of light incident on the light detector.

7. A printing device according to claim 6, the measurement signal being representative of variation in intensity of light incident on the light detector according to axial location of the droplet detector.

8. A printing device according to claim 7, an amplitude of the measurement signal being dependent on a difference between an axial location of the droplet detector and an axial location of the droplet generator.

9. A printing device according to claim 8, the controller being to determine the location of the droplet generator by determining an axial location of the droplet detector that corresponds to a maximum amplitude of the measurement signal to be the axial location of the droplet generator.

10. A printing device according to claim 1, the controller further being to calculate at least one element of a correction vector for correcting print data, based on the determined location of the droplet generator.

11. A printing device according to claim 1, the printing device being a page-wide array printer.

12. A printing device according to claim 1, the droplet generator being located in an overlap region of a print head die, wherein the overlap region of the print head die overlaps, in the axial direction, an overlap region of an adjacent print head die.

13. A method, comprising:

providing a droplet detector at a known axial location along a predefined axis;

providing a droplet generator at an unknown axial location along the predefined axis;

emitting a droplet from the droplet generator;

measuring, with the droplet detector, a parameter affected by the emission of the droplet from the droplet generator; and determining, based on the measurement of the parameter, a distance along the predefined axis of the unknown axial location from the known axial location.

14. A non-transitory machine readable storage medium encoded with instructions executable by a processor, the machine-readable storage medium comprising:

instructions to position a droplet detector at a selected location;

instructions to emit a droplet from a droplet generator;

instructions to receive a measurement signal from the droplet detector;

instructions to calculate, based on a received measurement signal from the droplet detector, a location of the droplet generator relative to the selected location.

* * * * *